US006851334B2

(12) United States Patent
Hsien

(10) Patent No.: US 6,851,334 B2
(45) Date of Patent: Feb. 8, 2005

(54) MULTIPURPOSE SOCKET WRENCH

(76) Inventor: Chih-Ching Hsien, 235 Chung-Ho Box 8-24, Taipei (TW)

( * ) Notice: Subject to any disclaimer, the term of this patent is extended or adjusted under 35 U.S.C. 154(b) by 81 days.

(21) Appl. No.: 10/208,887

(22) Filed: Jul. 29, 2002

(65) Prior Publication Data

US 2003/0056624 A1 Mar. 27, 2003

(30) Foreign Application Priority Data

Sep. 26, 2001 (TW) ..... 90124475 A

(51) Int. Cl.[7] ..... B25B 13/46
(52) U.S. Cl. ..... 81/63.1; 81/177.85; 81/60
(58) Field of Search ..... 81/59.1, 60, 61, 81/62, 63, 23.1, 63.2, 177.85

(56) References Cited

U.S. PATENT DOCUMENTS 2,869,410 A * 1/1959 Prichard ..... 81/63
4,328,720 A * 5/1982 Shiel ..... 81/63
5,295,422 A * 3/1994 Chow ..... 81/177.85
2003/0121371 A1 * 7/2003 Chiu ..... 81/63.1
2003/0131692 A1 * 7/2003 Huang ..... 81/60

* cited by examiner

*Primary Examiner*—James G. Smith

(57) ABSTRACT

A multipurpose socket wrench includes a handle having a box at one end, a driving member, the driving member having a hollow ratchet unit disposed at one side and coupled to the box of the handle and a coupling unit with equiangularly spaced pawls disposed at the other side, and a socket for use with the driving member and the handle to rotate a bolt or nut, the socket having a polygonal coupling hole disposed at one side and adapted to receive the workpiece and a plurality of pawls equiangularly spaced at the other side for engagement with the pawls of the driving member for enabling the socket to be driven by the handle to rotate the workpiece.

6 Claims, 17 Drawing Sheets

MULTIPURPOSE SOCKET WRENCH

BACKGROUND OF THE INVENTION

The present invention relates to wrenches, and more specifically, to a multipurpose socket wrench, which can be easily driven to rotate the workpiece with less effort.

A variety of socket wrenches have been disclosed for grasping and turning nuts, bolts, etc., and have appeared on the market. FIGS. 20 and 22 show two different socket wrenches according to the prior art. These socket wrenches are commonly comprised of a handle, and a socket adapted to rotate a bolt or nut with the handle. The handle has a driving shaft of square or hexagonal cross section perpendicularly disposed at one end. The socket has a coupling hole adapted to receive the driving shaft of the handle, and a receiving hole adapted to receive the workpiece. These conventional socket wrenches have numerous drawbacks as outlined hereinafter.

1. Because the sockets fit only particular bolts and nuts, the application range of these convention socket wrenches is limited.
2. Because the diameter of the coupling hole of the socket is shorter than the diameter of its receiving hole, driving force is not transmitted from the handle to the workpiece linearly, much effort should be employed when driving the handle to rotate the workpiece. This drawback is more apparent in the prior art socket wrench shown in FIG. 22.
3. In order to make the coupling hole, the socket must have a certain height. However, because the socket must be made having a certain height, the material cost is high. Due to this reason, the socket is heavy and expensive.

SUMMARY OF THE INVENTION

The present invention has been accomplished under the circumstances in view. It is one object of the present invention to provide a multipurpose socket wrench, which is practical to grasp and turn square head bolts and nuts as well as hexagon head bolts and nuts. It is another object of the present invention to provide a multipurpose socket wrench, which bears a high torque. It is still another object of the present invention to provide a multipurpose socket wrench, which saves much material consumption. To achieve these and other objects of the present invention, the multipurpose socket wrench includes a handle having a box at one end, a driving member, the driving member having a hollow ratchet unit disposed at one side and coupled to the box of the handle and a coupling unit with equiangularly spaced pawls disposed at the other side, and a socket for use with the driving member and the handle to rotate a bolt or nut the socket having a polygonal coupling hole disposed at one side and adapted to receive the workpiece and a plurality of pawls equiangularly spaced at the other side for engagement with the pawls of the driving member for enabling the socket to be driven by the handle to rotate the workpiece.

DETAILED DESCRIPTION OF THE PREFERRED EMBODIMENT

Figure 1:
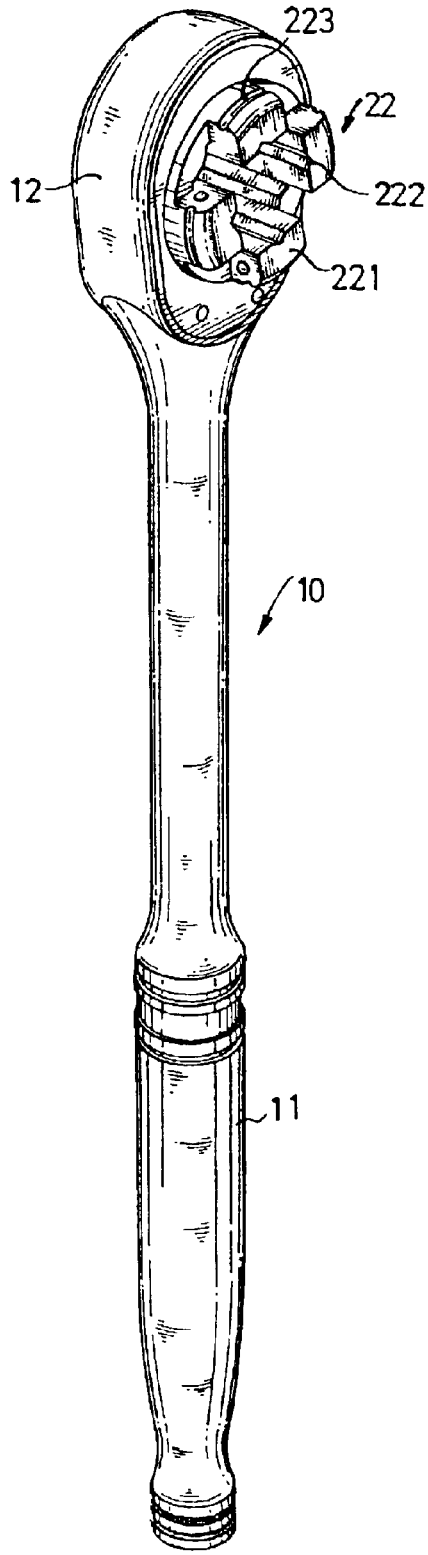
FIG. 1 is a perspective view of a multipurpose socket wrench according to the present invention (the socket excluded).
Figure 2:
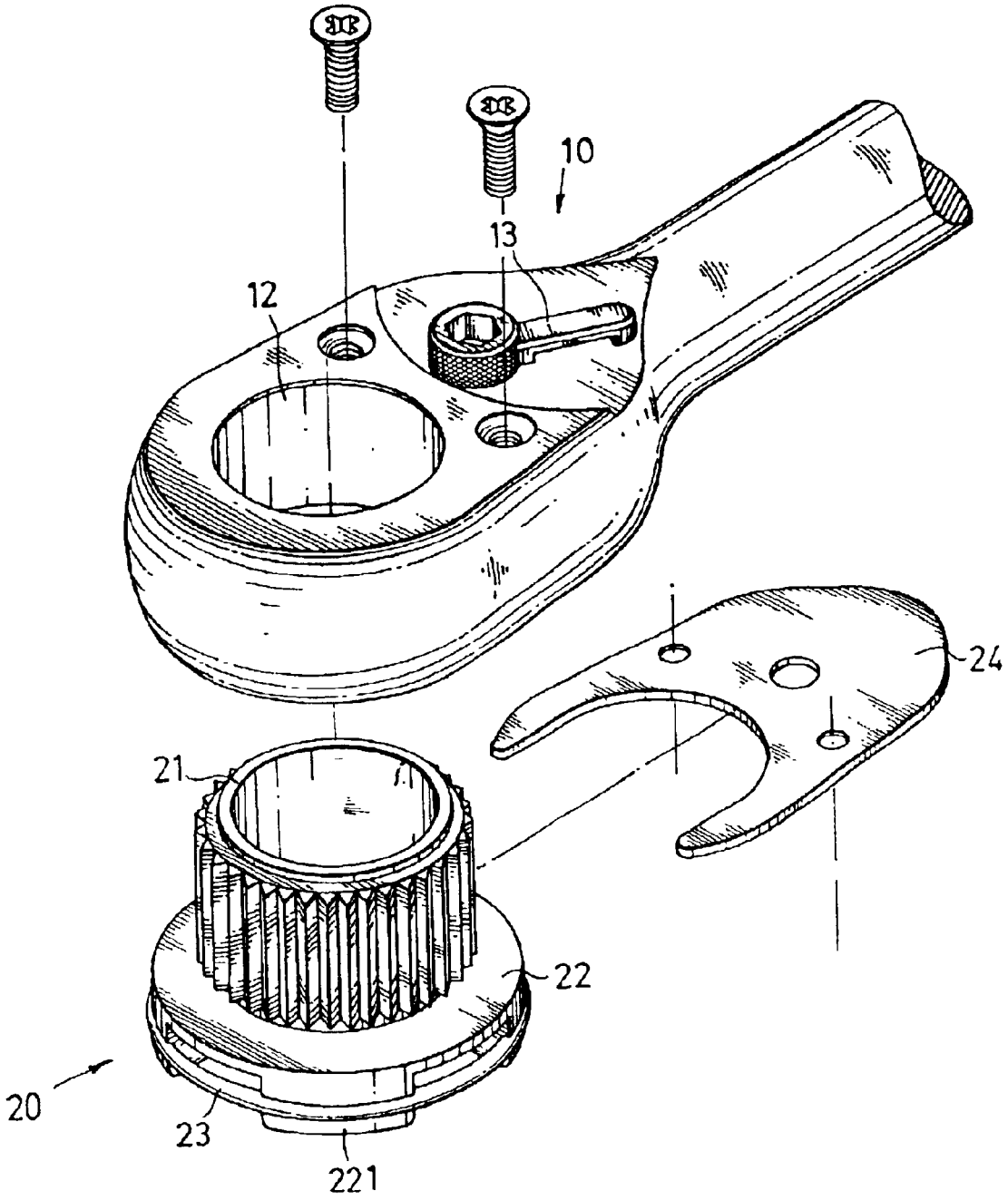
FIG. 2 is an exploded view in an enlarged scale of a part of the multipurpose socket wrench shown in FIG. 1.

Referring to FIGS. from 1 through 6, a multipurpose socket wrench in accordance with a first embodiment of the present invention is shown comprised of a handle 10, a driving member 20 mounted in one end of the handle 10, and a socket 30 to be detachably coupled to one end of the driving member 20.

The handle 10 is an elongated rod member having a grip 11 at one end and a box 12 at the other end. A toothed stop block (not shown) is supported on a spring (not shown) inside the box 12, and driven by a lever 13 to control the direction of rotation of the driving member 20 in the box 12.

The driving member 20 is shaped like a hollow, stepped cylinder having a ratchet unit 21 inserted into the box 12 of the handle 10, and a coupling unit 22 disposed outside the box 12 of the handle 10 for coupling to the socket 30. The coupling unit 22 comprises a plurality of equiangularly spaced pawls 221, each pawl 221 having a V-groove 222 disposed at an inner side. Further, a locating plate 24 is fixedly fastened to the handle 10 to secure the ratchet portion 21 of the driving member 20 to the handle 10, enabling the driving member 20 to be rotated in the box 12.

The socket 30 is a hollow cylindrical member having a coupling unit 31 disposed at one side for coupling to the coupling unit 22 of the driving member 20 and a polygonal receiving hole 32 disposed at the other side for coupling to a bolt or nut. The coupling unit 31 comprises a plurality of equiangularly spaced pawls 311 for engaging into the spaces in between the pawls 221 of the coupling unit 22 of the driving member 20, each pawl 311 having a V-groove 312 disposed at an inner side. After the receiving hole 32 of the socket 30 attached to the workpiece, the driving member 20 is attached with the handle 10 to the socket 30 by engaging the pawls 221 of the coupling unit 22 of the driving member 20 into the spaces in between the pawls 221 of the coupling unit 22 of the driving member 20, so that the operator can turn the handle 10 to rotate the workpiece efficiently with less effort.

Figure 4:
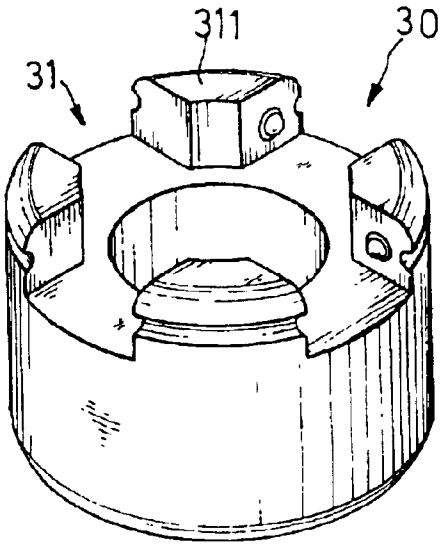
FIG. 4 is an elevational view of an alternate form of the socket for the multipurpose socket wrench according to the present invention.
Figure 9:
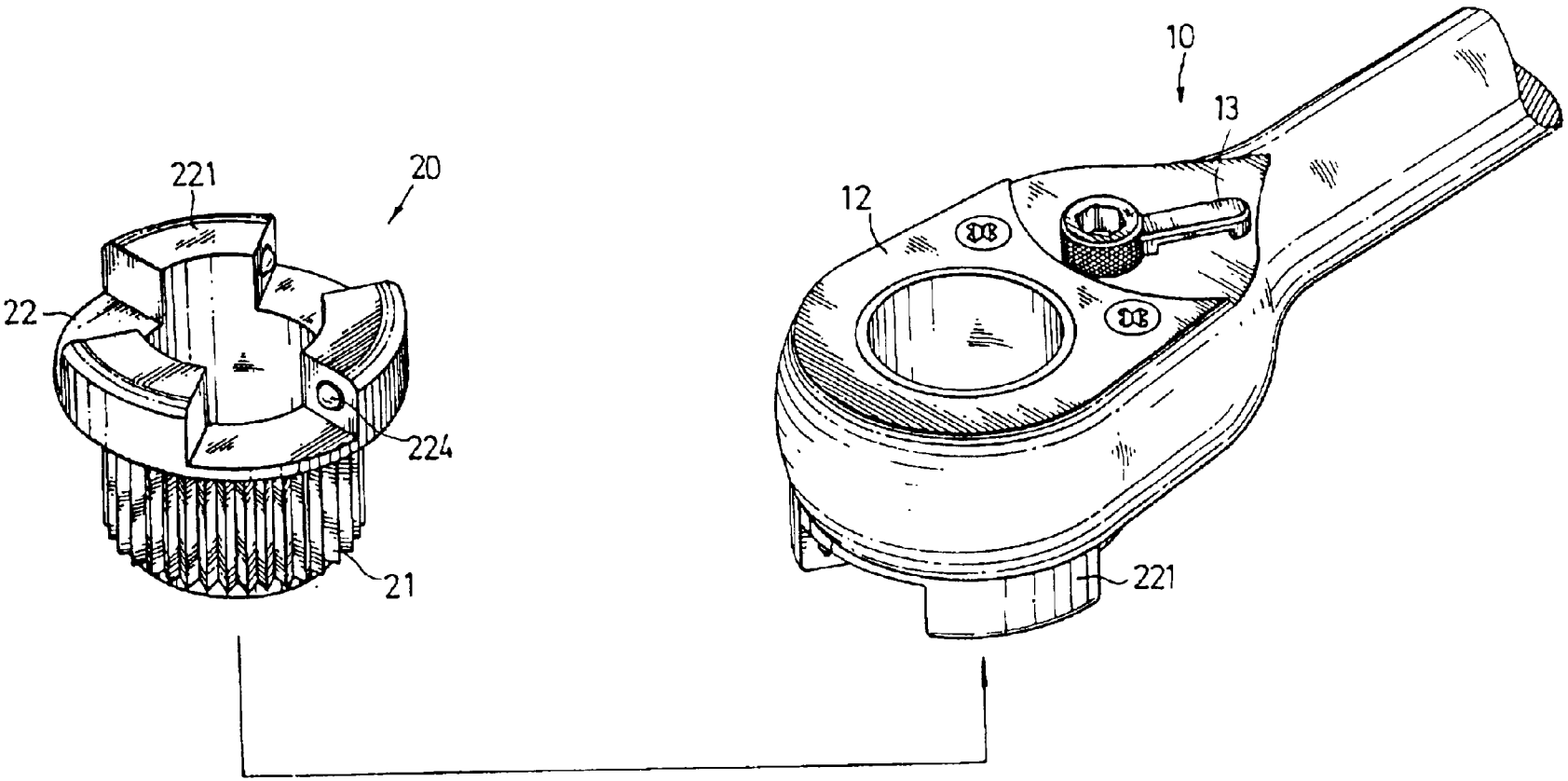
FIG. 9 is an exploded view in an enlarged scale of another alternate form of the multipurpose socket wrench according to the present invention.
Figure 10:
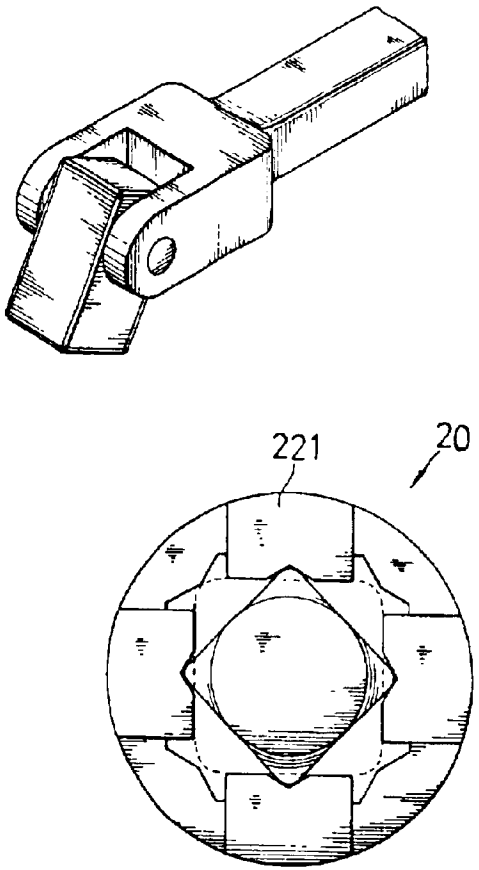
FIG. 10 is a schematic drawing showing the application of the driving member with a conventional wrench.
Figure 11:
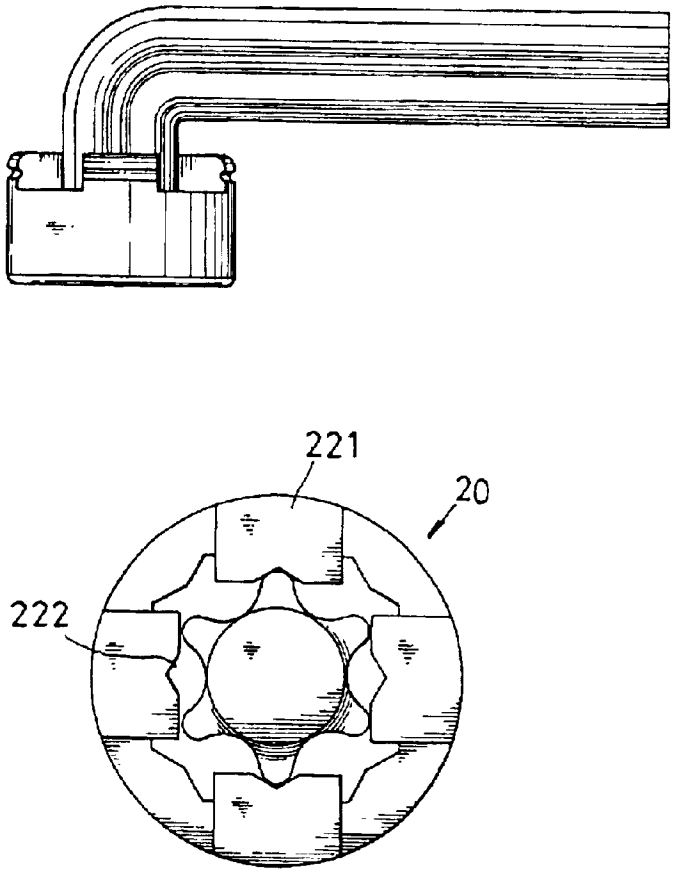
FIG. 11 is a schematic drawing showing the application of the driving member with another conventional wrench.
Figure 12:
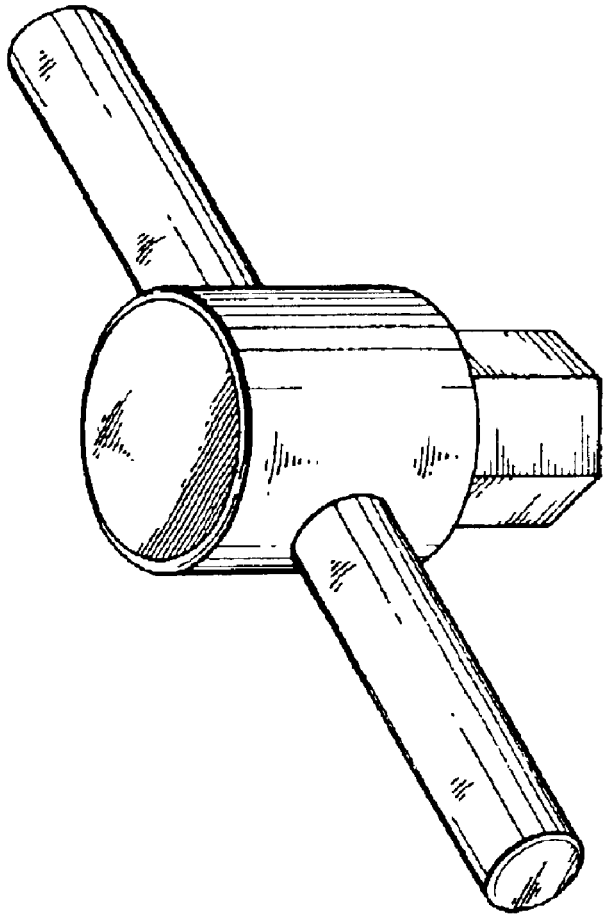
FIG. 12 is a schematic drawing showing the application of the driving member with still another conventional wrench.
Figure 12:
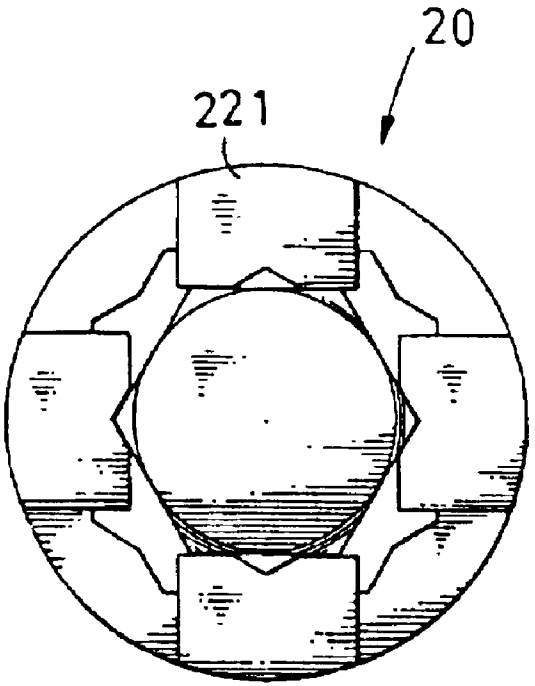

Referring to FIGS. from 1 through 5 again, the pawls 221 and 311 each have a peripheral locating groove 223. After engagement of the pawls 221 of the coupling unit 22 of the driving member 20 into the spaces in between the pawls 221 of the coupling unit 22 of the driving member 20, a retainer ring 23 is fastened to the locating groove 223 of each of the pawls 221 and 311 to secure the driving member 20 and the socket 30 together. Alternatively, spring-supported steel balls 224 can be respectively provided at one lateral side of each of the pawls 221 of the driving member 20 for engaging into a respective recessed hole at one lateral side of each of the pawls 311 of the socket 30 (see also FIGS. 4 and 9).

Figure 3:
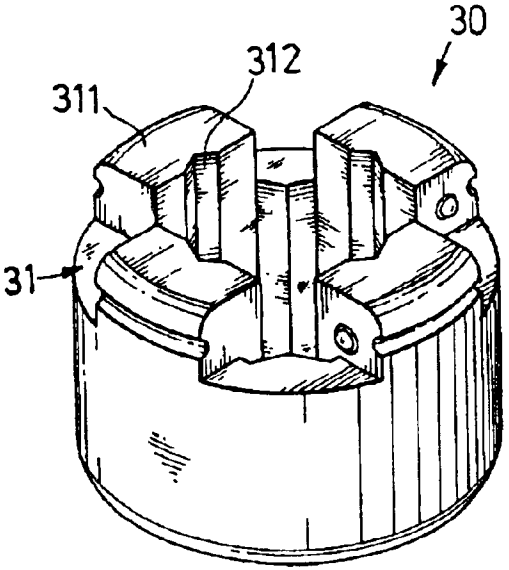
FIG. 3 is an elevational view of one socket for the multipurpose socket wrench according to the present invention.
Figure 5:
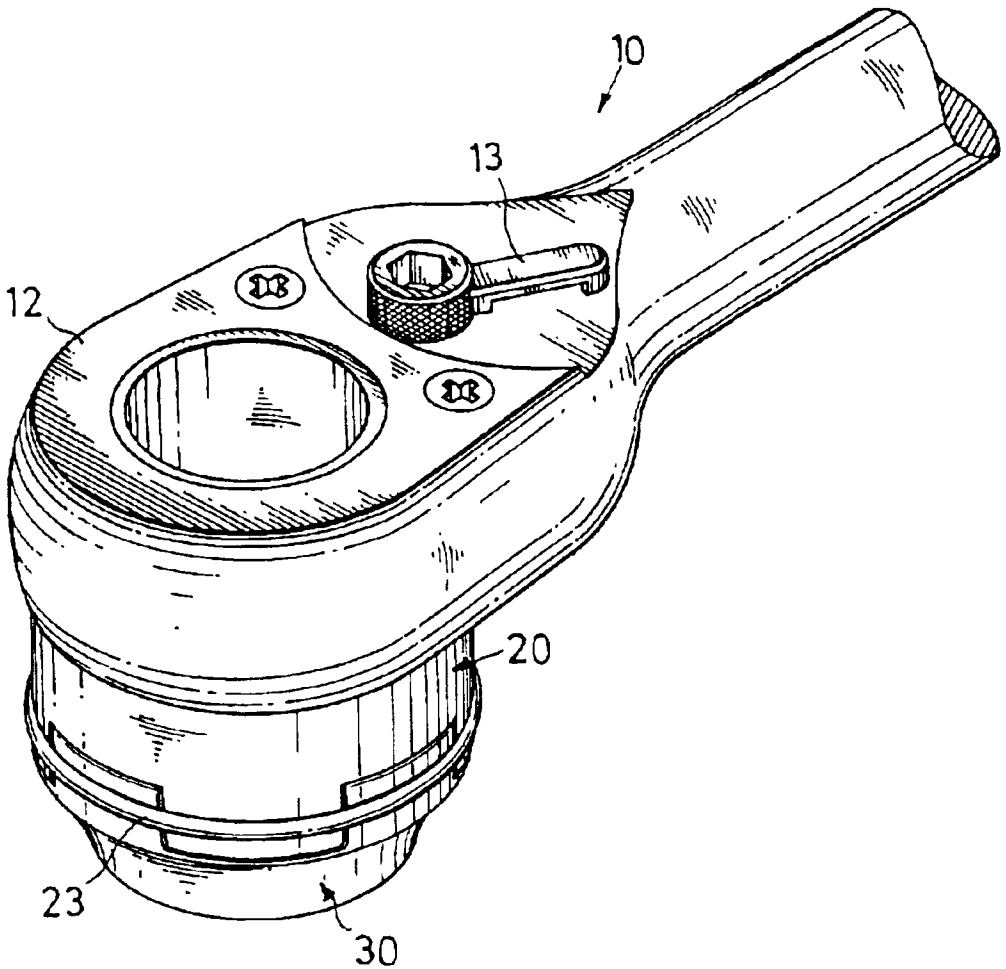
FIG. 5 is a perspective view of the present invention, showing the socket fastened to the driving member.
Figure 6:
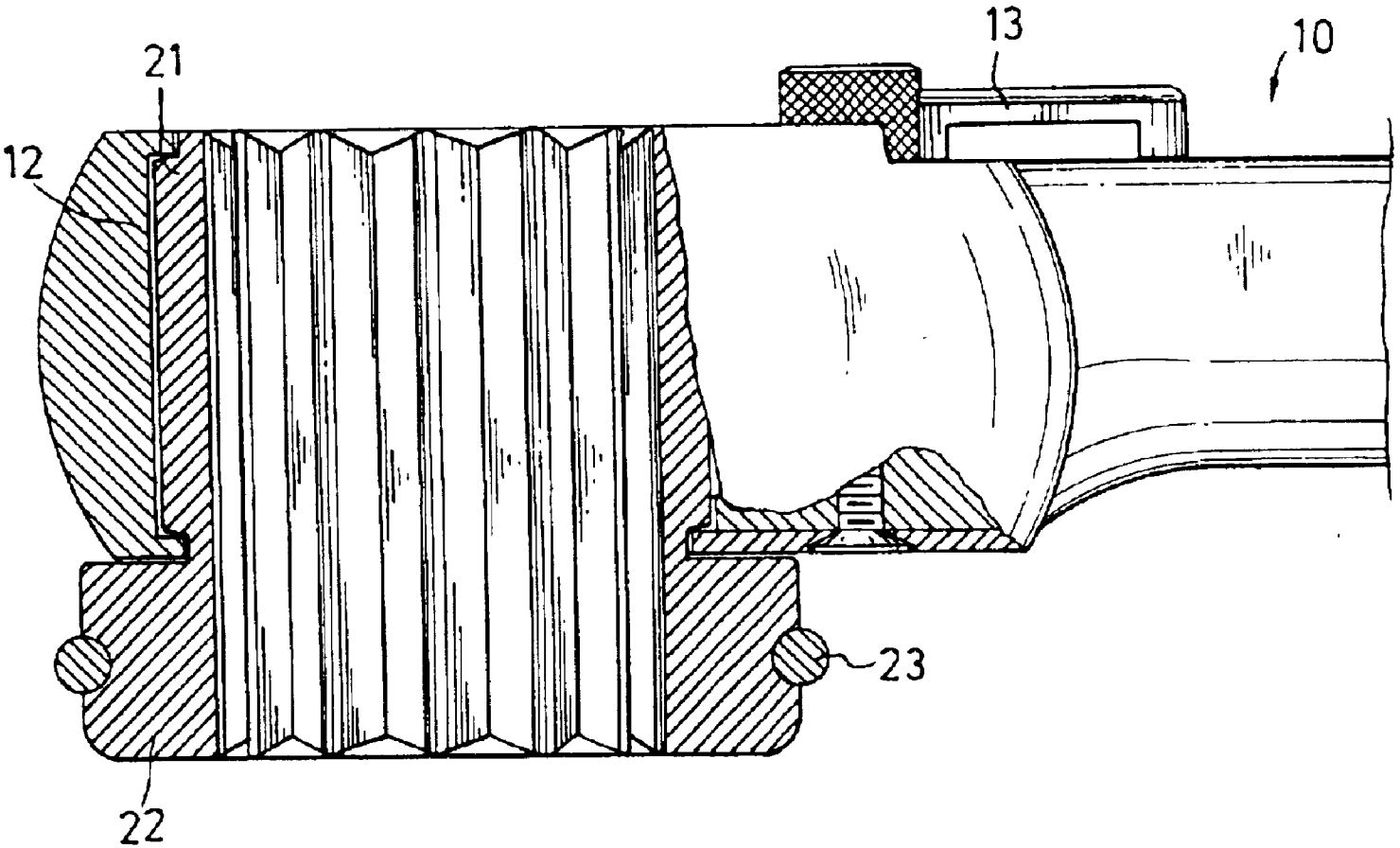
FIG. 6 is a sectional assembly view of FIG. 3.
Figure 7:
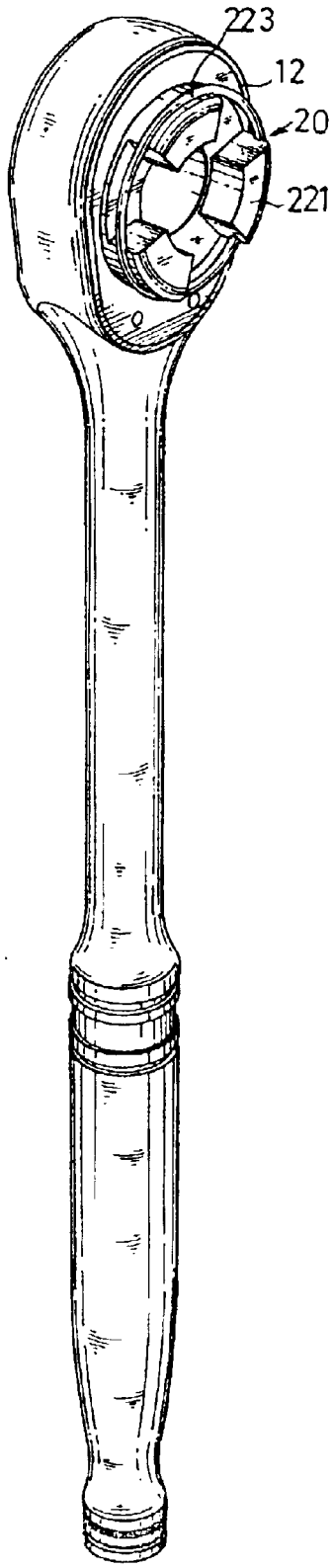
FIG. 7 is an elevational view of an alternate form of the multipurpose socket wrench according to the present invention (the socket excluded).
Figure 8:
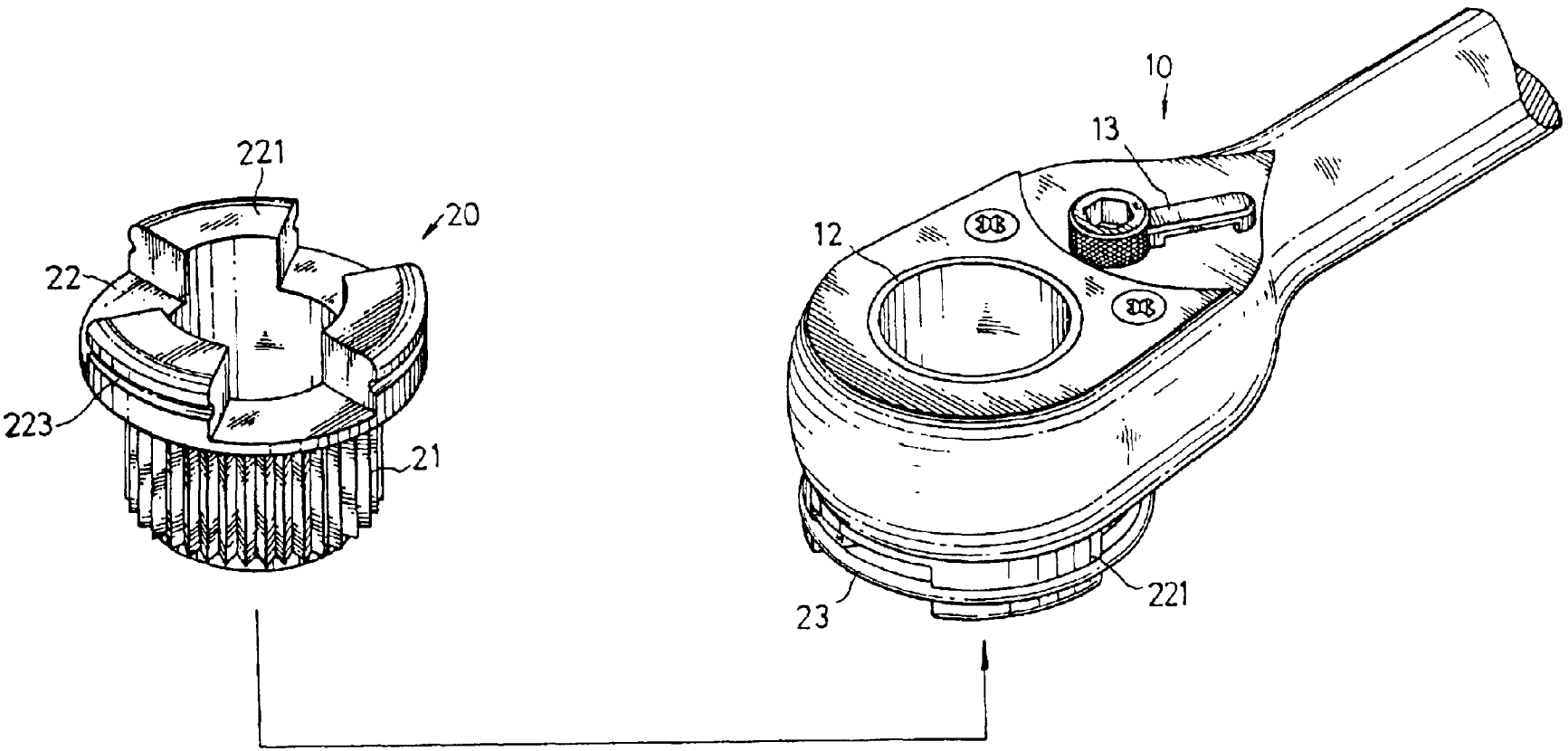
FIG. 8 is an exploded view in an enlarged scale of a part of FIG. 7.

Referring to FIGS. from 7 through 9 and FIGS. 3 and 4 again, the driving member 20 and the socket 30 can be made having four pawls, three pawls, or two pawls. Further, the pawls 221 and 311 may have any of a variety of shapes.

Figure 13:
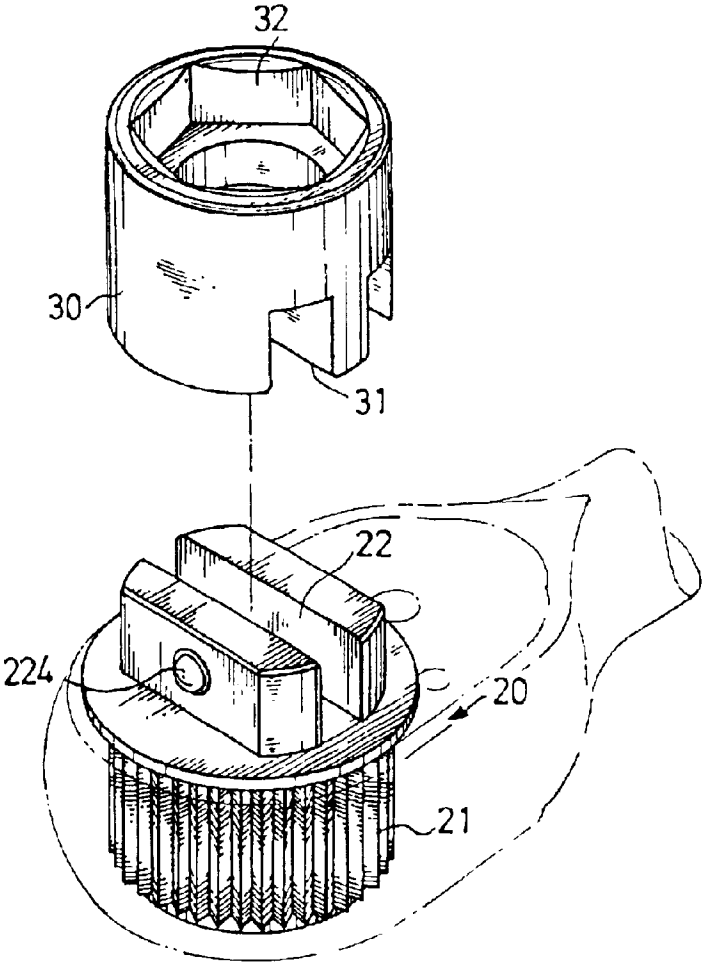
FIG. 13 illustrates another coupling arrangement between the driving member and the socket according to the present invention.
Figure 14:
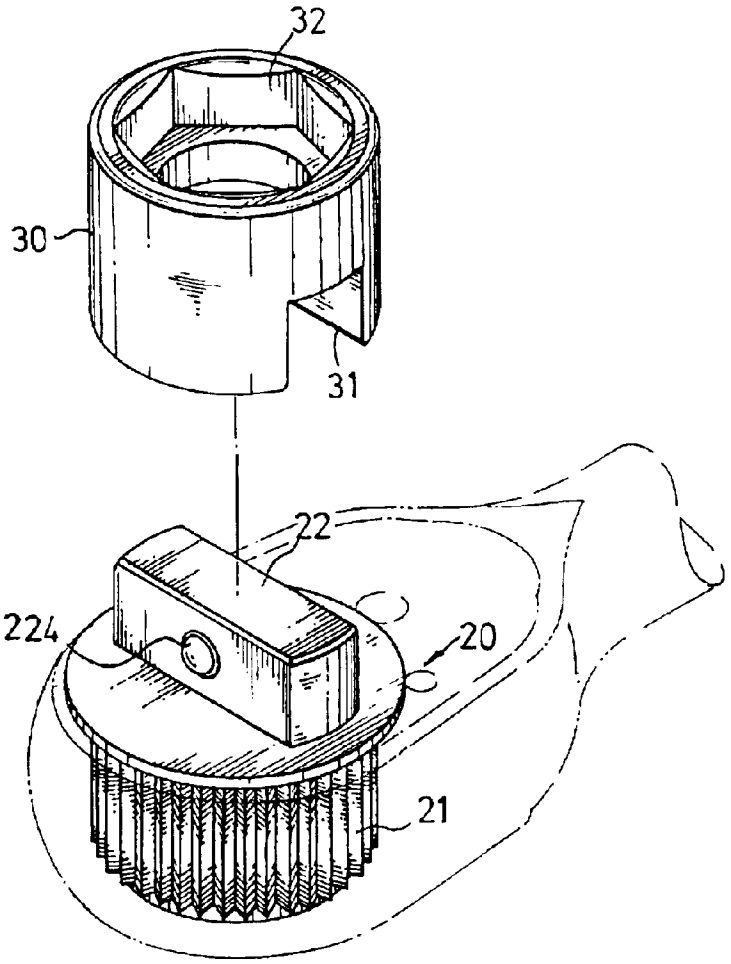
FIG. 14 illustrates still another coupling arrangement between the driving member and the socket according to the present invention.

FIGS. 13 and 14 show different alternate forms of the present invention. In FIG. 13, the coupling unit 22 of the driving member 20 comprises two parallel coupling blocks integral with one side of the ratchet unit 21, and the coupling unit 31 of the socket 30 comprises two parallel coupling notches adapted to receive the parallel coupling blocks of the coupling unit 22 of the driving member 20. Further spring-supported steel balls 224 are respectively provided in the parallel coupling blocks of the coupling unit 22 of the driving member 20 and adapted to engage respective recessed holes in the coupling unit 31 of the socket 30. In FIG. 14, the coupling unit 22 of the driving member 20 is comprised of a coupling block integral with one side of the ratchet unit 21, and the coupling unit 31 of the socket 30 comprises a coupling notch adapted to receive the coupling block of the coupling unit 22 of the driving member 20. Similarly, spring-supported steel balls 224 are provided at the coupling unit 22 of the driving member 20 and adapted to engage respective recessed holes in the coupling unit 31 of the socket 30.

Figure 15:
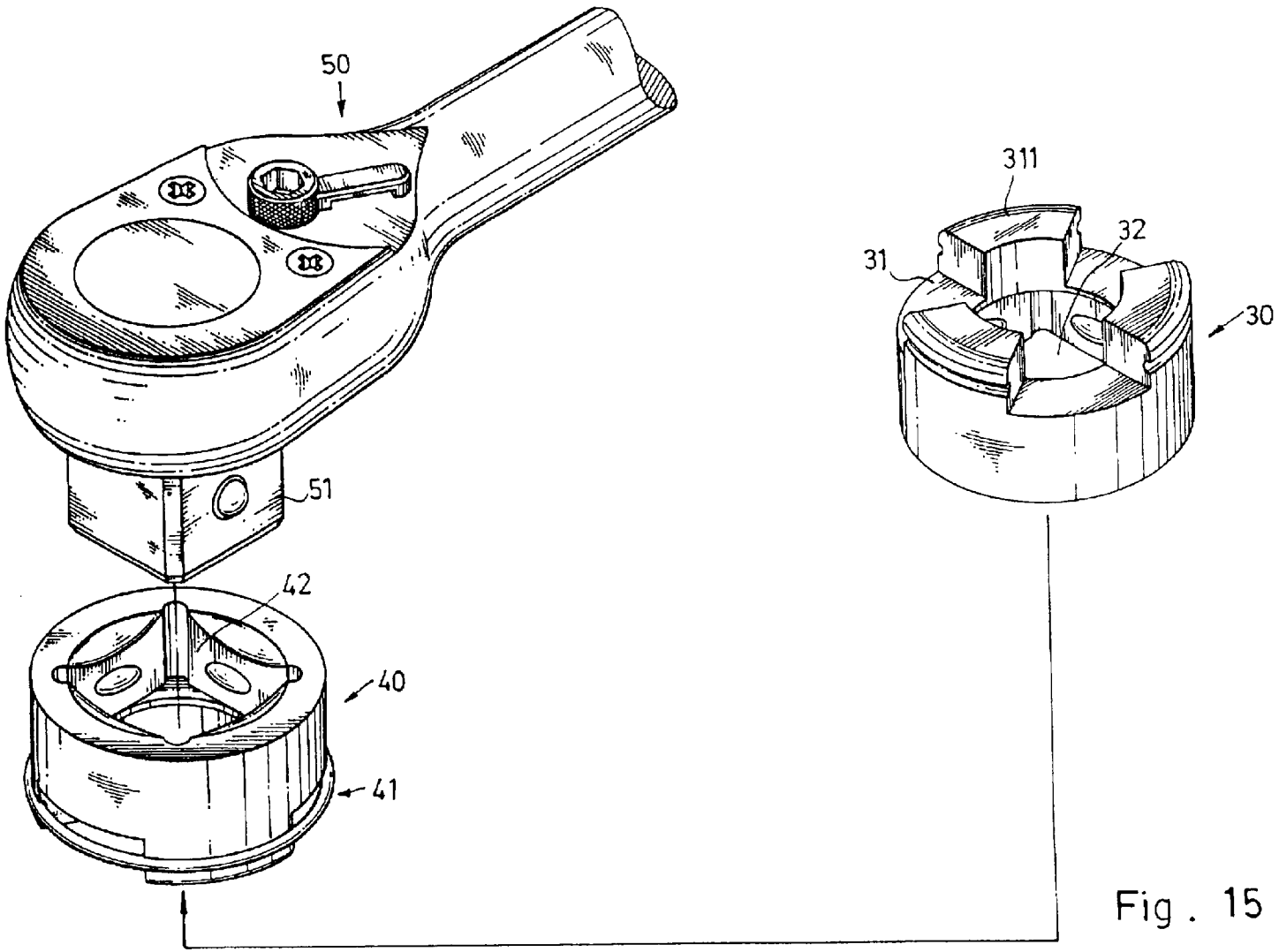
FIG. 15 illustrates the use of an adapter between the socket and a prior art wrench according to the present invention.
Figure 16:
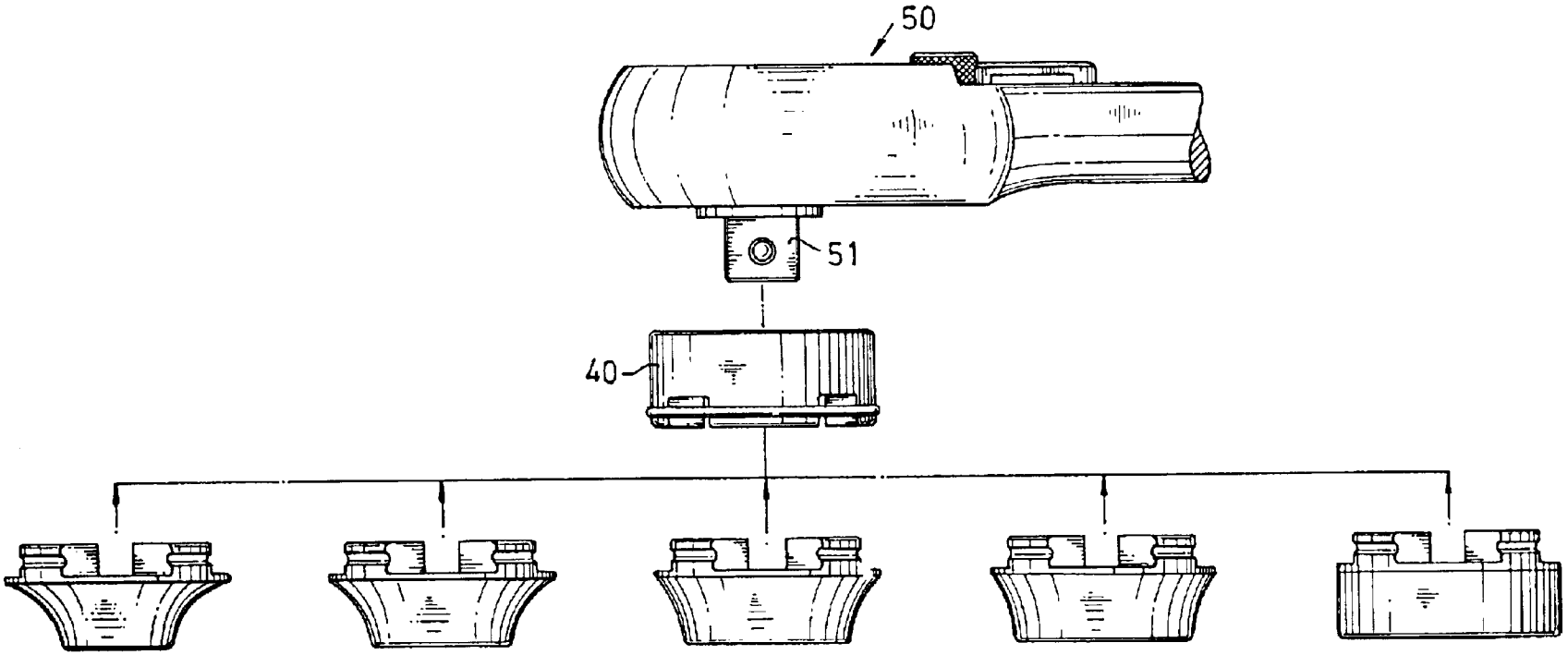
FIG. 16 illustrates the use of the adapter between a prior art wrench and one of a set of sockets according to the present invention.
Figure 18:
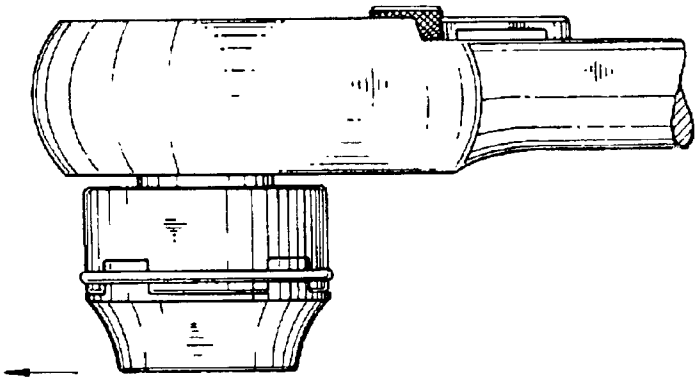
FIG. 18 illustrates a prior art wrench attached with the socket of the present invention.
Figure 17:
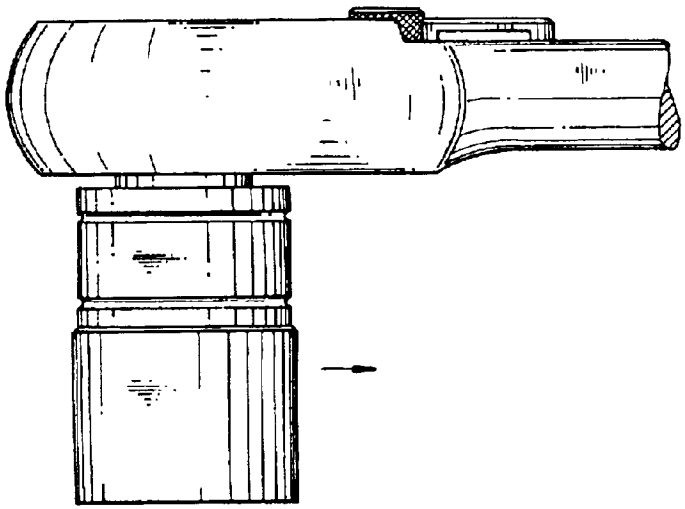
Fig. 17 PRIOR ART
FIG. 17 illustrates a socket wrench according to the prior art.
Figure 19:
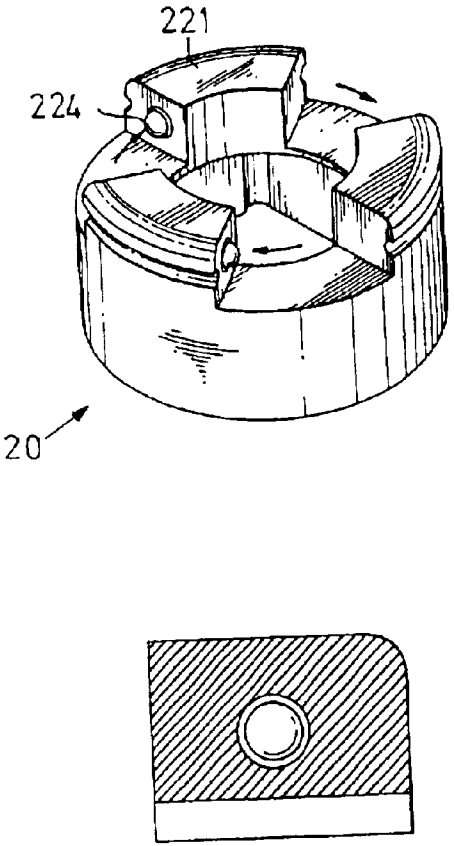
FIG. 19 illustrates elevational and sectional views of the socket pawl force receiving area according to the present invention.
Figure 20:
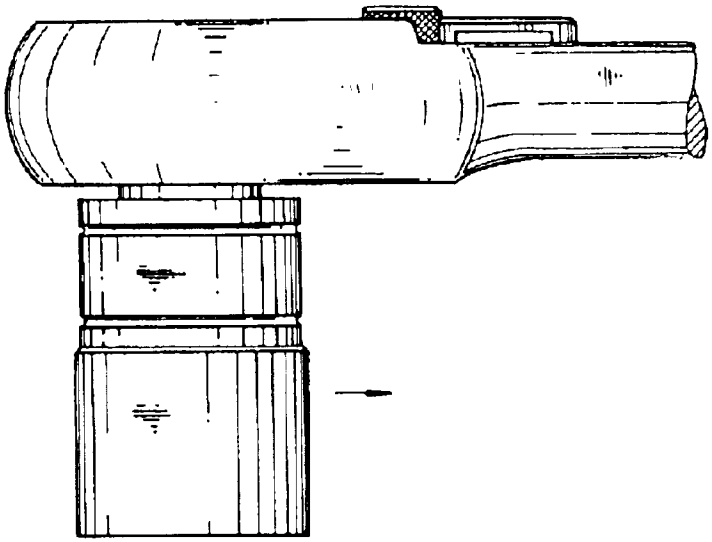
Fig. 20 PRIOR ART
FIG. 20 illustrates the outer appearance of a prior art socket wrench.
Figure 21:
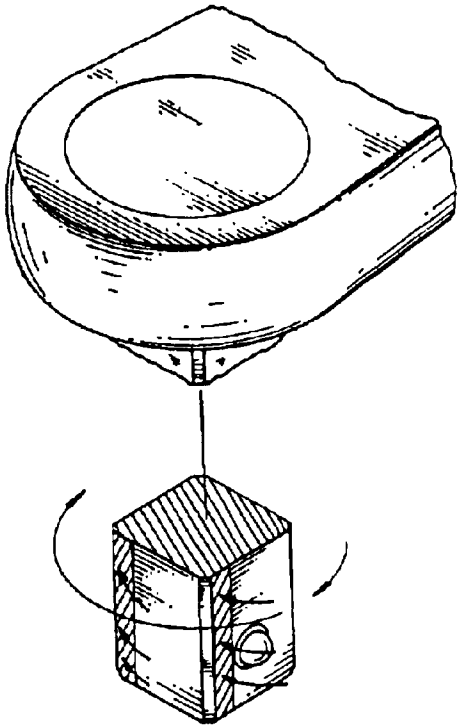
Fig. 21 PRIOR ART
FIG. 21 is a schematic drawing showing the force receiving area of the prior art socket wrench.
Figure 22:
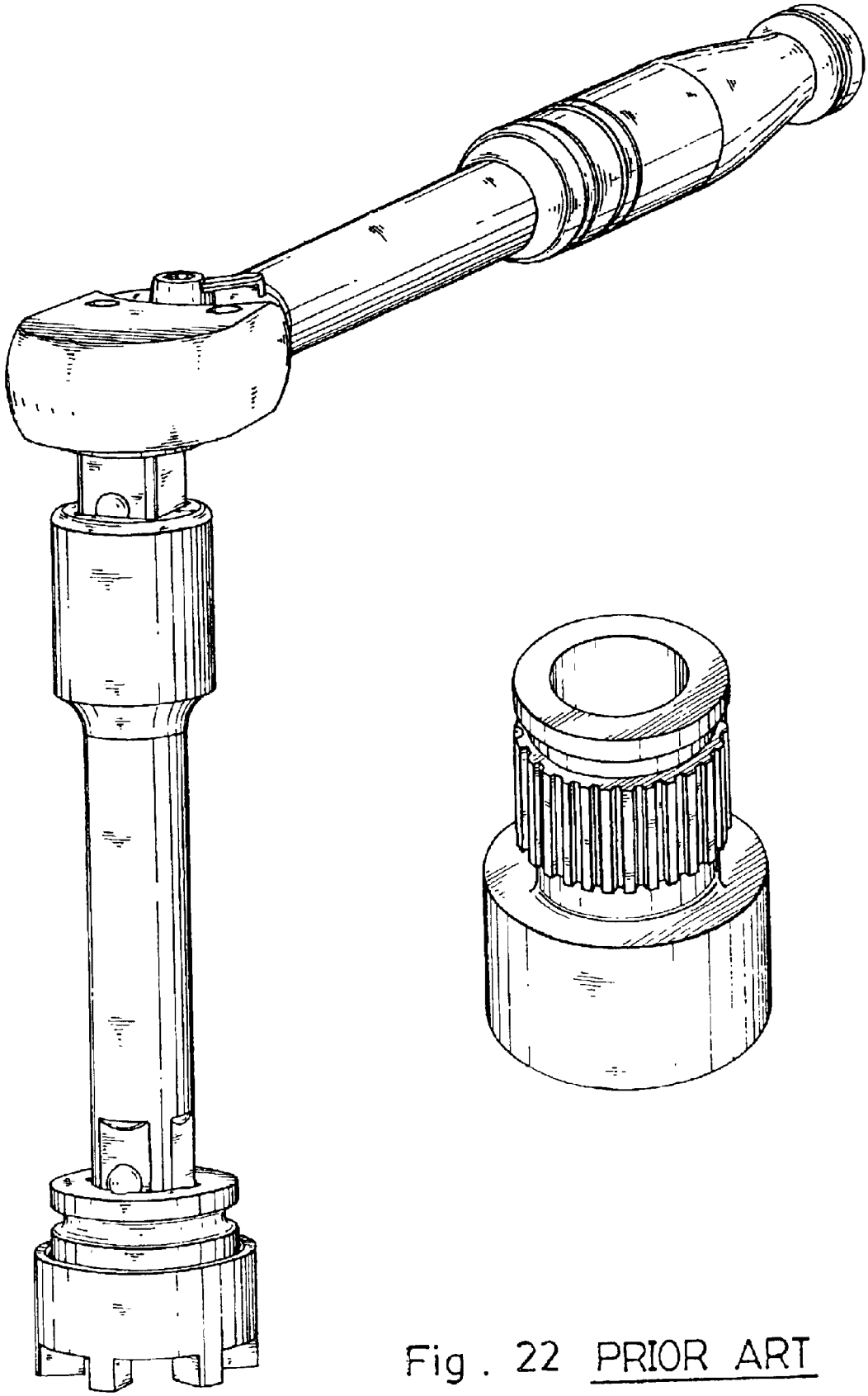
Fig. 22 PRIOR ART
FIG. 22 illustrates another structure of socket wrench according to the prior art.

Referring to FIGS. 15 and 16, an adapter 40 is provided for securing the socket 30 to a conventional wrench 50. The adapter 40 comprises a polygonal receiving hole 42 disposed at one side and adapted to receive the polygonal driving shaft 51 of a conventional wrench 50, and a coupling unit 41 of structure similar to the coupling unit 22 of the aforesaid driving member 20) for coupling to the coupling unit 31 of the socket 30.

As indicated above, the socket 30 can be attached to the driving member 20 for turning bolts and nuts. Alternatively, the driving member 20 can be used with any of a variety of conventional wrenches and spanners (see FIGS. from 10 through 12).

A prototype of multipurpose socket wrench has been constructed with the features of FIGS. 1~19. The multipurpose socket wrench functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A multipurpose socket wrench comprising:

a handle, said handle having a grip at one end thereof and a box at an opposite end thereof;

a hollow driving member for turning with said handle to rotate a workpiece, said driving member comprising a ratchet unit coupled to said box of said handle, and a coupling unit integral with one side of said driving member and disposed outside said box of said handle, the coupling unit of said driving member comprising a plurality of equiangularly spaced pawls, the pawls of the coupling unit of said driving member each having a V-groove disposed at an inner said; and a hollow cylindrical socket adapted to rotate a bolt or nut with said driving member and said handle, said socket comprising a coupling unit disposed at one said thereof for coupling to the coupling unit of said driving member and a polygonal receiving hole disposed at an opposite said thereof for coupling to the bolt or nut to be rotated, the coupling unit of said socket comprising a plurality of equiangularly spaced pawls for engaging into the spaces in between the pawls of the coupling unit of said driving member, the pawls of the coupling unit of said socket each having a V-groove disposed at an inner said.

2. The multipurpose socket wrench as claimed in claim 1, wherein the number of the pawls of the coupling unit of said driving member and the number of the pawls of the coupling unit of said socket are 3.

3. The multipurpose socket wrench as claimed in claim 1, wherein the number of the pawls of the coupling unit of said driving member and the number of the pawls of the coupling unit of said socket are 4.

4. The multipurpose socket wrench as claimed in claim 1, wherein the number of the pawls of the coupling unit of said driving member and the number of the pawls of the coupling unit of said socket are 5.

5. The multipurpose socket wrench as claimed in claim 1, wherein the pawls of the coupling unit of said driving member and the pawls of the coupling unit of said socket each have a peripheral locating groove for the positioning of a retainer ring to secure said socket and said driving member together after engagement of the pawls of said socket in the spaces in between the pawls of said driving member.

6. The multipurpose socket wrench as claimed in claim 1, wherein the coupling unit of said driving member comprises at least one spring-supported steel ball, and the coupling unit of said socket comprises at least one recessed hole adapted to receive the at least one spring-supported steel ball of the coupling unit of said driving member respectively.

* * * * *